United States Patent [19]

Sasaki

[11] 4,417,453

[45] Nov. 29, 1983

[54] LIQUID SEPARATOR FOR USE IN A REFRIGERATING AIR CONDITIONING APPARATUS

[75] Inventor: Yoshio Sasaki, Nagasaki, Japan

[73] Assignee: Mitsubishi Denki Kabushiki Kaisha, Tokyo, Japan

[21] Appl. No.: 358,606

[22] Filed: Mar. 15, 1982

[30] Foreign Application Priority Data

Apr. 17, 1981 [JP] Japan ..... 56-56071[U]

[51] Int. Cl.[3] ..... F25B 43/00

[52] U.S. Cl. ..... 62/503; 62/513

[58] Field of Search ..... 62/503, 509, 512, 513

[56] References Cited

U.S. PATENT DOCUMENTS

| | | | |
|---|---|---|---|
| 2,461,342 | 2/1949 | Obretter, Jr. | 62/503 |
| 2,750,757 | 6/1956 | Zearfoss, Jr. | 62/512 |
| 3,060,704 | 10/1962 | Miller | 62/503 |
| 3,177,680 | 4/1965 | Rasovich et al. | 62/503 |
| 3,362,184 | 1/1968 | Jensen | 62/503 |
| 3,444,699 | 5/1969 | Harnish | 62/503 |
| 3,563,053 | 2/1971 | Bottum | 62/503 |

FOREIGN PATENT DOCUMENTS 47-20907 6/1972 Japan .

*Primary Examiner*—Ronald C. Capossela

*Attorney, Agent, or Firm*—Wenderoth, Lind & Ponack

[57] ABSTRACT

A liquid separator in a refrigerating air conditioning apparatus to be provided in the pipeline connecting the compressor and the evaporator thereof is disclosed wherein a container having generally a horizontal cylindrical form with closed ends has its inside divided into two spaces by a rectangular partition plate elongating horizontally and secured at its three sides to the inside walls of the container, the other side being separated from one of the ends so as to leave a gap therebetween. Inlet and exit pipes for a refrigerant gas are secured to the outer wall of the container to be opened into the two spaces, a high pressure liquified refrigerant coil being disposed within the one of the spaces to which the inlet pipe opens so that its principal flow direction intersects orthogonally the direction of the inlet pipe.

The container is further provided with a tube having a bottomed end introduced therein so as to have the bottom end reside in the gap, the tube mounting therein a temperature sensing element adapted to coact with a high pressure liquified refrigerant flow rate regulating valve mounted to a pipe conveying the liquified refrigerant to the evaporator.

2 Claims, 3 Drawing Figures

LIQUID SEPARATOR FOR USE IN A REFRIGERATING AIR CONDITIONING APPARATUS

BACKGROUND OF THE INVENTION

The present invention relates to a refrigerating air conditioning apparatus and more particulary to an improvement in a liquid separator therefor to be provided in the pipeline connecting the compressor and the evaporator therein.

Hitherto, there has been used as a liquid separator for a refrigerating air conditioning apparatus of this kind a separator as shown in FIG. 1 of the attached drawings, wherein the reference numeral 1 designates a container, 2 an inlet pipe for a refrigerant gas from an evaporator (not shown), 3 an exit pipe for the refrigerant gas, 4 a liquified refrigerant coil provided at the bottom part of container 1, 10 a suction pipe leading to a compressor (not shown), and 11 a temperature sensing tube mounted on suction pipe 10 and adapted to coact with a flow rate regulating valve (not shown) to regulate the flow of the liquified refrigerant to the evaporator.

The operation of the liquid separator shown in FIG. 1 is as follows.

The refrigerant gas leaving the evaporator (not shown) enters container 1 through refrigerant gas inlet pipe 2 with a small quantity of the liquified refrigerant being entrained therein. In container 1 the velocity of the refrigerant gas is rapidly retarded so that the liquid portion contained in the refrigerant gas drops in container 1 due to the difference in specific weight between the liquified refrigerant and the refrigerant gas, only the gas portion being sucked to the compressor (not shown) from refrigerant gas exit pipe 3 through suction pipe 10. The liquified refrigerant thus separated from the refrigerant gas and accumulated in the bottom of container 1 cools the high pressure liquified refrigerant which is flowing within liquified refrigerant coil 4, is in turn gasified, and is also sucked into the compressor through exit pipe 3. The high pressure liquified refrigerant flowing within liquified refrigerant coil 4 is supplied to the evaporator to be evaporated therein, returning to container 1 through gas inlet pipe 2. In this case, it is desirable that at least a portion of the liquified refrigerant supplied to the evaporator be allowed to be maintained in the liquid state until it reaches the exit of the evaporator in order to increase the capacity of the evaporator by utilizing the latent heat of the liquid portion of the refrigerant therein. However, since there is the fear of possible damage to the compressor if it happens to suck in the liquid portion of the refrigerant, it is the usual practice that the liquid portion is separated from the refrigerant gas by a liquid separator, and in addition suction pipe 10 of the compressor is provided with temperature sensing tube 11, a control sensor for a flow rate regulating valve (not shown) for the high pressure liquified refrigerant to be supplied to the evaporator, to sense the temperature of suction pipe 10 so that the liquid portion is not carried to the compressor.

However, since the conventional liquid separator has the construction described above, it takes a long time before the liquid separator is cooled and also before the temperature sensing tube is cooled at the time of starting the air conditioning apparatus after it has been at a standstill for a long time, and on the other hand an excessive amount of the liquified refrigerant accumulates in the container at the time when the temperature sensing tube is about to be cooled. Thus, it will be appreciated that the conventional liquid separator as exemplified herein inevitably exhibits a tendency to be subjected to a time lag before it is properly operated. Therefore, owing to this time lag, when the apparatus restarts, as the flow rate regulating valve begins to throttle the flow of high pressure liquified refrigerant due to the sensing of a low temperature by the temperature sensing tube, the supply of refrigerant gas to the compressor becomes small, the suction pressure of the compressor being lowered temporarily to an extraordinary valve, and an abnormal stoppage of the compressor may occur. Such a phenomena constitutes one of the defects inherent in a conventional liquid separator in a refrigerating air conditioning apparatus.

SUMMARY OF THE INVENTION

It is an object of the present invention to provide a liquid separator for use in a refrigerating air conditioning apparatus which can eliminate the defects inherent in the conventional liquid separator as described above.

It is another object of the present invention to provide a liquid separator for use in a refrigerating air conditioning apparatus in which a liquified refrigerant coil is arranged at a position where it comes easily into contact with the refrigerant gas entering from an evaporator so that the heat exchange between the liquified refrigerant and the refrigerant gas takes place effectively.

It is a still further object of the present invention to provide a liquid separator for use in a refrigerating air conditioning apparatus in which a temperature sensing tube is able to be introduced into the container of the separator so that the temperature of the refrigerant gas after heat exchange with the high pressure liquified refrigerant can be precisely detected.

In accordance with the present invention a liquid separator for use in a refrigerating air conditioning apparatus to be provided in the pipeline connecting the compressor and the evaporator therein is provided which comprises a container having generally a horizontal cylindrical form with closed ends, a generally rectangular partition plate disposed horizontally within the container to divide the inside thereof into two spaces, with one side of the plate being separated from one of the closed ends thereof to leave a gap therebetween, a liquified refrigererant coil disposed within one of the spaces so as to substantially fill it, with the end portions thereof protruding outwards from the container, a refrigerant gas inlet pipe secured to the outer wall of the container so as to open into the one of the spaces wherein the liquified refrigerant coil is disposed, and a refrigerant gas exit pipe secured to the outer wall of the container so as to open into the other of the spaces, whereby the principal flow direction of the liquified refrigerant within the coil is adapted to be orthogonal to the direction of the inlet pipe.

In a preferred embodiment of the present invention a tube with one end closed is secured to the container such that the tube is passed through the container so as to have its closed end located within the gap, the tube advantageously having mounted therein a temperature sensing element to coact with a high pressure liquified refrigerant flow rate regulating valve to be provided in a pipe to supply the liquified refrigerant to the evaporator.

BRIEF DESCRIPTION OF THE DRAWINGS

These and other objects of the present invention will become more readily apparent upon reading the following specification and upon making reference to the accompanying drawings, in which.

DESCRIPTION OF THE PREFERRED EMBODIMENT

Figure 1:
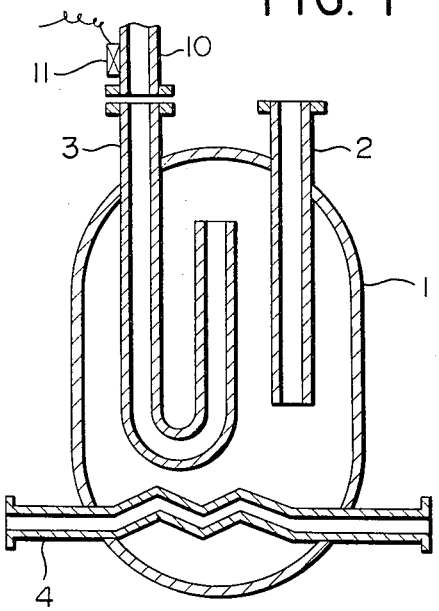
FIG. 1 is a diagrammatical longitudinal sectional view of a liquid separator for use in a conventional refrigerating air conditioning apparatus.
Figure 2:
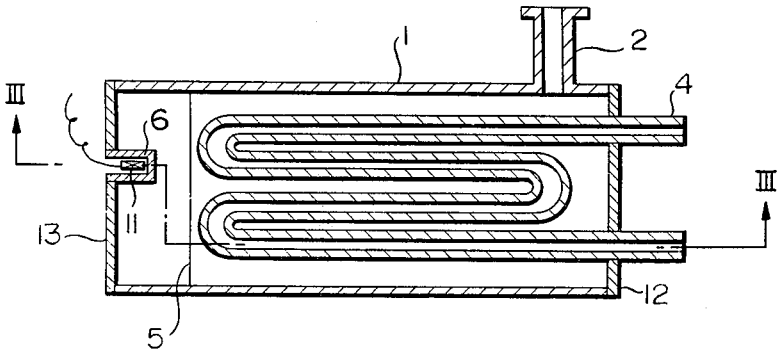
FIG. 2 is a diagrammatical longitudinal view of one embodiment of a liquid separator in a refrigerating air conditioning apparatus in accordance with the present invention.
Figure 3:
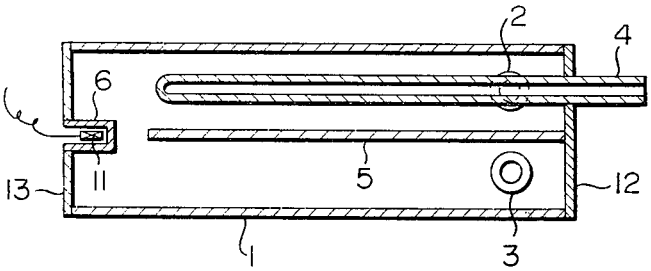
FIG. 3 is a sectional view of FIG. 2 taken along the lines III—III in FIG. 2.

Referring now to FIG. 2 of the drawings, the reference numeral 1 designates a container having a horizontal cylindrical form and a large diameter with the ends being sealed by flat plates 12 and 13, and 5 designates a rectangular partition plate extending horizontally within container 1 substantially at the mid portion of its height so as to divide the inside thereof into two identical spaces, partition plate 5 being sealingly secured along its three sides to the inside walls of the cylindrical part of container 1 and one of its end plates 12 but separated at the remaining side from the inside of the other of the end plates 13 with a gap being left therebetween. A small tube 6 is sealingly secured to plate 13 so as to protrude therethrough into container 1 so that the inner end of tube 6 is located within the gap, the inner end of tube 6 being closed. As shown in FIGS. 2 and 3, sealingly secured to the outer wall of container 1 and opening into one of the spaces formed therein by partition plate 5 is a refrigerant gas inlet pipe 2, a refrigerant gas exit pipe 3 being similarly sealingly connected to the outer wall of container 1 and opening into the other of the spaces formed therein by partition plate 5, inlet and exit pipes 2 and 3 being disposed so as to be substantially aligned vertically. A liquified refrigerant coil 4 is disposed within the space formed within container 1 into which refrigerant gas inlet pipe 2 opens so that the end portions of coil 4 sealingly pass through end plate 12.

The operation of the embodiment of the present invention the construction of which has been described above will now be explained.

The refrigerant gas from an evaporator (not shown) enters container 1 from refrigerant gas inlet pipe 2 with a liquid portion being contained therein, the gas flowing in container 1 axially along partition plate 5 toward end plate 13. In the course of the passage of the refrigerant the liquid portion thereof comes into contact with liquified refrigerant coil 4 so as to spatter thereover, evaporating as a refrigerant gas. The evaporated gas impinges upon end plate 13 and changes its course through an angle of 180°, the gas being sucked by a compressor (not shown) through refrigerant gas exit pipe 3. A temperature sensing element 11 for a flow rate adjusting valve is introduced into tube 6 from its outer open end, tube 6 being mounted on end plain plate 13 so that the inner closed end is located in the gap, i.e. the position where the refrigerant gas changes its flow direction within chamber 1 through an angle of 180°, and temperature sensing element 11 is adapted to detect the temperature of the refrigerant after it is fed to container 1 from the evaporator and its liquid portion has been evaporated therein as the result of its being heated by the high pressure liquified refrigerant flowing within liquified refrigerant coil 4.

Although in the embodiment described above the flow direction of the refrigerant gas in container 1 has been assumed to be horizontal, the flow direction may be vertical such that the refrigerant gas enters container 1 downwards from the upper part thereof and is turned upwards, or refrigerant gas inlet and exit pipes 2 and 3 may be connected to container 1 at any positions in addition to those shown in the drawings, e.g. at the side of container 1 opposite to that where inlet and exit pipes 2 and 3 are shown connected thereto.

Further, it is generally true that since lubricant oil is also separated from the refrigerant gas within container 1 simultaneously with the separation of the liquid portion therefrom, a device is also provided in container 1 to return the separated lubricant oil to the compressor, and in the embodiment described and shown herein such a device is assumed to be also provided in accordance with the general practice, although the description thereof is omitted because it is thought not to be necessary for the understanding of the present invention.

From the foregoing it will be appreciated that, in accordance with the present invention, since the liquified refrigerant coil is arranged within the container at a position where it can easily come into contact with the refrigerant gas from the evaporator and the temperature sensing element is adapted to be introduced into the container, the heat exchange between the liquified refrigerant within the coil and the surrounding refrigerant gas takes place in a superior manner to the prior art liquid separator and the temperature of the evaporated refrigerant gas can be directly and finely detected, resulting in a refrigerating air conditioning apparatus in which a pressure change in the compressor contained therein due to a time lag of the liquid separator at the time of its startup can be obviated.

Although a preferred embodiment of the present invention has been described and illustrated, it will be understood by those skilled in the art that modifications may be made in the structure, form, and relative arrangement of parts without necessarily departing from the spirit and scope of the invention. Accordingly, it should be understood that all such modifications which fall within the scope of the invention are covered by the appended claims.

What is claimed is:

1. A liquid separator for use in a refrigerating apparatus and adapted to be provided in a refrigerant gas pipeline connecting the evaporator and the compressor of the refrigerating apparatus, said separator comprising: a container having a generally cylindrical form with end plates closing the ends thereof, a partition plate in said container and dividing the inside of said container into two spaces which are in communication with each other at one of the longitudinal ends of said container, a liquified refrigerant coil disposed withon one of said spaces and extending longitudinally along said partition plate in a zig-zag fashion and substantially filling said one space and having both end portions extending through the container at one of the ends of said container for receiving liquified refrigerant from the compressor, a refrigerant gas inlet in said container and opening into said one of said spaces at the other longitudinal end of said container, a refrigerant gas outlet in said container and opening out of the other of said spaces at said other longitudinal end of said container.

2. A liquid separator as claimed in claim 1 further comprising a tube having a closed end protruding into said container at said one longitudinal end of said container where said spaces are in communication with each other, and a refrigerant temperature sensing means in said tube.

* * * * *